US011764494B2

(12) United States Patent
Stolze

(10) Patent No.: US 11,764,494 B2
(45) Date of Patent: Sep. 19, 2023

(54) CONNECTING TERMINAL FOR CONNECTING ELECTRICAL CONDUCTORS

(71) Applicant: WAGO Verwaltungsgesellschaft mbH, Minden (DE)

(72) Inventor: Henry Stolze, Bad Frankenhausen (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 197 days.

(21) Appl. No.: 17/387,516

(22) Filed: Jul. 28, 2021

(65) Prior Publication Data

US 2022/0037810 A1 Feb. 3, 2022

(30) Foreign Application Priority Data

Jul. 30, 2020 (DE) ..... 10 2020 120 151.6

(51) Int. Cl.
*H01R 4/48* (2006.01)
*H01R 13/502* (2006.01)

(52) U.S. Cl.
CPC ..... *H01R 4/4836* (2013.01); *H01R 4/4845* (2013.01); *H01R 13/502* (2013.01)

(58) Field of Classification Search
CPC .. H01R 4/4836; H01R 4/4845; H01R 13/502; H01R 11/09; H01R 4/4818; H01R 11/01
See application file for complete search history.

(56) References Cited

U.S. PATENT DOCUMENTS 5,865,654 A 2/1999 Shimirak et al.
6,250,960 B1 6/2001 Youtsey
8,998,634 B2 4/2015 Koellmann
10,033,119 B2 * 7/2018 Koellmann ..... H01R 4/52
11,024,988 B2 6/2021 Koellmann
11,329,403 B2 * 5/2022 Koellmann ..... H01R 4/4827
11,545,764 B2 * 1/2023 Meyer ..... H01R 4/4818
(Continued)

FOREIGN PATENT DOCUMENTS

CN 109802249 A 5/2019
DE 7511815 U 10/1975
(Continued)

*Primary Examiner* — Abdullah A Riyami
*Assistant Examiner* — Nader J Alhawamdeh
(74) *Attorney, Agent, or Firm* — Muncy, Geissler, Olds & Lowe, P.C.

(57) ABSTRACT

A connecting terminal for connecting at least one first electrical conductor to a second electrical conductor, the connecting terminal including a housing with a first conductor insertion opening for inserting the first electrical conductor and with a second conductor insertion opening for inserting the second electrical conductor, the first and the second conductor insertion openings being arranged on opposite sides of the housing, the connecting terminal including a contact insert, which includes a first clamping spring, a second clamping spring and a busbar, the first and the second clamping springs being fastened in end areas of the busbar facing away from each other, and a free space being present between the first and the second clamping springs, the connecting terminal including an inner piece as a further separate component, which is arranged at least with a middle section predominantly in the free space between the first and second clamping springs.

24 Claims, 5 Drawing Sheets

(56) References Cited

U.S. PATENT DOCUMENTS

| | | | | |
|---|---|---|---|---|
| 2009/0017691 | A1* | 1/2009 | Breen, IV | H01R 9/03 439/658 |
| 2010/0068925 | A1 | 3/2010 | Daily | |
| 2017/0331200 | A1* | 11/2017 | Koellmann | H01R 13/506 |
| 2018/0254568 | A1* | 9/2018 | Koellmann | H01R 9/2675 |
| 2022/0037810 | A1* | 2/2022 | Stolze | H01R 4/4836 |

FOREIGN PATENT DOCUMENTS

| | | | |
|---|---|---|---|
| DE | 102007050683 | A1 | 4/2009 |
| DE | 102013101830 | A1 | 7/2014 |
| DE | 102014119421 | A1 | 6/2016 |
| DE | 102016116510 | A1 | 3/2018 |
| DE | 102018101381 | A1 | 7/2019 |
| DE | 202018004944 | U1 | 1/2020 |
| EP | 1850417 | A2 | 10/2007 |
| EP | 2752944 | A2 | 7/2014 |

* cited by examiner

CONNECTING TERMINAL FOR CONNECTING ELECTRICAL CONDUCTORS

This nonprovisional application claims priority under 35 U.S.C. § 119(a) to German Patent Application No. 10 2020 120 151.6, which was filed in Germany on Jul. 30, 2020 and which is herein incorporated by reference.

BACKGROUND OF THE INVENTION

Field of the Invention

The present invention relates to a connecting terminal for connecting at least one first electrical conductor to a second electrical conductor. The connecting terminal has a housing with a first conductor insertion opening for inserting the first electrical conductor and with a second conductor insertion opening for inserting the second electrical conductor. The first and second conductor insertion openings are arranged on opposite sides of the housing. The connecting terminal includes a contact insert, which includes a first clamping spring, a second clamping spring and a busbar.

Description of the Background Art

Connecting terminals of this type are known, for example, from DE 10 2014 119 421 B4, which corresponds to US 2017/0331200, which is incorporated herein by reference.

SUMMARY OF THE INVENTION

It is therefore an object of the present invention to further improve a connecting terminal.

Due to the inner piece present as a separate component and inserted into the housing, a multifunctional component is expanded, which may implement a multiplicity of different functions with little complexity, as further explained below. The structure and complexity of the connecting terminal remain clear, since only relatively few individual parts continue to be necessary. A connecting terminal of this type may be designed, in particular, as a feed-through terminal. The spring-force clamping connections formed by the clamping springs and the busbar may be designed as push-in connections. For example, the inner piece may perform certain mechanical and electrical functions, e.g., tasks of supporting the first and/or second clamping spring, insulating tasks, e.g., an improvement in the air gaps and creepage distances. The inner piece may take on, for example, the functions of the conductor and spring guiding system as well as the function of a conductor stop and also make mounting the connecting terminal easier.

In an example, it is therefore proposed that the inner piece is made from an insulating material, e.g., from plastic. The inner piece may abut at least one inner wall of the housing.

The inner piece can be configured to at least partially support and/or abut an area of the first and/or second clamping spring in a form-fitting manner. For this purpose, the contact insert is positioned and held in the housing in a stable manner. The inner piece may have a contour, at least in areas, which corresponds to a part of the contour of the clamping spring, at least where the first and/or the second clamping spring(s) abut(s) the inner piece.

The contact insert may also alternatively or additionally be positioned and held in the housing via form-fitting retaining edges and/or locking connections.

The contact insert can form a self-supporting structural unit with the inner piece, which may be inserted into the housing in a preassembled manner. In this way, the mounting of the connecting terminals is made particularly easy and time-saving.

The first and second clamping springs, can each include a clamping leg and an arc-shaped section, the arc-shaped sections of the first and second clamping springs being able to be arranged and a shorter distance from each other than the clamping legs in the mounted state. The arc-shaped sections of the clamping springs therefore face each other. In this way, a compact feed-through terminal with push-in connections on both sides may be created with little complexity. A free space may be present between the arc-shaped sections of the clamping springs.

According to an example, it is provided that the inner piece can have a first continuation protruding from the middle section in the direction of the first conductor insertion opening and/or the inner piece can have a second continuation protruding from the middle section in the direction of the second conductor insertion opening.

The first continuation may form a supporting or holding element for the first clamping spring. The second continuation may form a supporting or holding element for the second clamping spring.

It can also be provided that in the direction of the first conductor insertion opening, the first continuation extends at an angle, at least in sections, with respect to the conductor insertion direction of the first electrical conductor and/or in the direction of the second conductor insertion opening, the second continuation extends at an angle, at least in sections, with respect to the conductor insertion direction of the second electrical conductor.

A contour of the first or second continuation, which is well adapted to the shape of the clamping spring, may be implemented hereby, so that a good support effect of the clamping springs may be implemented with little complexity.

According to an example, it is provided that the first continuation is designed to overlap with the first clamping spring over at least 50% of the longitudinal extension of the first clamping spring in the conductor insertion direction of the first electrical conductor and/or the second continuation is designed to overlap with the second clamping spring over at least 50% of the longitudinal extension of the second clamping spring in the conductor insertion direction of the second electrical conductor.

In this way, the first or the second clamping spring may be supported by the first or second continuation over a large area of its longitudinal extension.

The housing can include a main housing part, which is designed as a one-part structural unit and extends at least predominantly from the first conductor insertion opening to the second conductor insertion opening. The connecting terminal may be manufactured with particularly little complexity hereby and be easily mounted. The main housing part may be provided with a relatively simple design, e.g., as a tubular component, which may be provided, e.g., from an extruded profile by being cut off. The main housing part may have a continuously smooth wall without structuring on the inside. The main housing part may be designed, e.g., as a square tubular piece without inner contours, including optional rounded longitudinal side edges on the inside and outside. The inner piece may be completely accommodated in the main housing part and therefore be completely enclosed by the main housing part.

The main housing part can have a tubular design and has a receiving space for receiving the contact insert.

The housing can include at least one first closure piece, which is insertable into the main housing part in the area of the first conductor insertion opening and is used to close the housing in the area of the first conductor insertion opening and/or the housing can include at least one second closure piece, which is insertable into the main housing part in the area of the second conductor insertion opening and is used to close the housing in the area of the second conductor insertion opening.

In this way, the main housing part may be closed either on one side or on both sides with little complexity, using a closure piece of this type. In an alternative embodiment, the main housing part may also already be provided with a corresponding closure on one side, so that a closure piece needs to be inserted only on one side. The particular closure piece may be connected to the main housing part, e.g., by locking, welding, caulking and/or gluing. The particular closure piece has a feed-through opening, through which the particular electrical conductor may be guided to the contact insert in the main housing part.

The first and the second closure pieces may have identical or different shapes.

The first closure piece can include at least one first projection protruding into the interior of the main housing part, and/or the second closure piece includes at least one second projection protruding into the interior of the main housing part. In this way, a closure piece of this type may be additionally used for the form-fitting support and/or abutting of an area of the first or second clamping spring. The supporting or abutting of the clamping springs then takes place at the particular first or second projection. The first projection may thus, for example, extend into the arc-shaped section of the first clamping spring. The second projection may, for example, extend into the arc-shaped section of the second clamping spring.

The first projection can be designed to overlap with the first clamping spring over at least 50% of the longitudinal extension of the first clamping spring in the conductor insertion direction of the first electrical conductor and/or the second projection is designed to overlap with the second clamping spring over at least 50% of the longitudinal extension of the second clamping spring in the conductor insertion direction of the second electrical conductor.

In this way, a particularly good supporting effect of the first clamping spring at the first projection or of the second clamping spring at the second projection may be achieved.

In the mounted state, the first and the second projection of the closure piece may each overlap with the continuation of the inner part in the longitudinal extension direction of the connecting terminal, so that a particular good supporting effect of the clamping springs may be achieved.

The first projection can have a convex outer contour at the free end, which is adapted to the concave inner contour of the first clamping spring adjacent to the first projection and/or the second projection has a convex outer contour at the free end, which is adapted to the concave inner contour of the second clamping spring adjacent to the second projection.

The concave inner contour of the first clamping spring or the second clamping spring may be, for example, the inner contour of the arc-shaped section of the particular clamping spring. In this way, the first projection may be inserted a particularly great distance into the first clamping spring, or the second projection may be inserted a particularly great distance into the second clamping spring.

The first closure piece and/or the second closure piece can each have window-like openings arranged in opposite side walls of the closure piece. The fixing of the first closure piece or the second closure piece in the main housing part is made easier hereby. The window-like openings may each be oppositely arranged, for example, in pairs on four side walls of the particular closure piece.

The first clamping spring can include at least two arc-shaped side webs, between which a clamping leg of the first clamping spring is arranged. This permits a very efficient manufacturing of the first clamping spring from a sheet metal component by means of stamping/bending process steps. A middle area may be stamped out of a rectangular sheet metal part, so that particular webs remain to the left and right thereof. This stamped-out area may be slightly shortened, if necessary, and may then form a clamping leg of the clamping spring. The remaining material areas on the side of the clamping leg may form the side webs in each case. They may be formed by bending steps in such a way that the arc-shaped sections of the clamping springs are generated. In addition, a remaining transverse web, which connects the side webs, may be used as a holding element for holding the clamping spring on the busbar.

The side webs and the clamping leg can protrude from a shared root area of the first clamping spring, the side webs being connected to each other on their ends at a distance from the root area via a transverse web. The transverse web may thus be used to connect the side webs. A relatively robust clamping spring arrangement is created hereby, which forms a closed frame around the clamping leg.

The transverse web can be arranged on the side of the busbar facing away from the clamping leg. In this way, the transverse web may be used as a fastening element for fastening the clamping spring on the busbar.

The first clamping spring can have an edge at the free end of the root area. The edge points in a direction which is predominantly oriented away from the running direction of the clamping leg. The edge of the root area may abut an inner wall of the housing, e.g., an inner wall of the main housing part. In this way, the clamping spring may be supported on the housing inner wall in the mounted state and/or upon a tensile loading and possibly dig slightly into this housing inner wall. The supporting effect is further improved hereby, and an increase of the pull-out forces is generated.

The second clamping spring may be provided with a design which is identical to or different from the first clamping spring.

The contact insert can be designed as a push-in connection for directly inserting the first and/or the second electrical conductor. In the case of a push-in connection of this type, a sufficiently stiff electrical conductor may inserted directly into the clamping point, i.e. without separately actuating the clamping leg.

The connecting terminal can be designed without an actuating element of the first and/or second clamping spring(s). This favors a particularly compact and slim structure of the connecting terminal.

The middle section of the inner piece can have a concave inner contour in the area facing the first clamping spring, which corresponds to a convex outer contour of the first clamping spring adjacent to the middle section and/or the middle section of the inner piece has a concave inner contour in the area facing the second clamping spring, which corresponds to convex outer contour of the second clamping spring adjacent to the middle section.

As a result, the clamping spring may also be additionally supported by the inner piece in its arc-shaped section, which has the convex outer contour.

The middle section of the inner piece can form a conductor stop for the first and/or second electrical conductor, which limits the insertion depth. This has the advantage that no additional elements are necessary to form a conductor stop. This functionality may also be handled directly by the inner piece. Due to the conductor stop, the user haptically feels when the first or second electrical conductor has been inserted far enough.

The object mentioned at the outset is also achieved by a connecting terminal for connecting at least one first electrical conductor to a second electrical conductor, the connecting terminal including a housing with a first conductor insertion opening for inserting the first electrical conductor and with a second conductor insertion opening for inserting the second electrical conductor, the first and the second conductor insertion openings being arranged on opposite sides of the housing, the connecting terminal including a contact insert, which has a first clamping spring, a second clamping spring and a busbar, the first and second clamping springs being fastened at end areas of the busbar facing away from each other, and a free space being present between the first and the second clamping springs. A connecting terminal of this type may also be advantageously combined with the features explained above.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
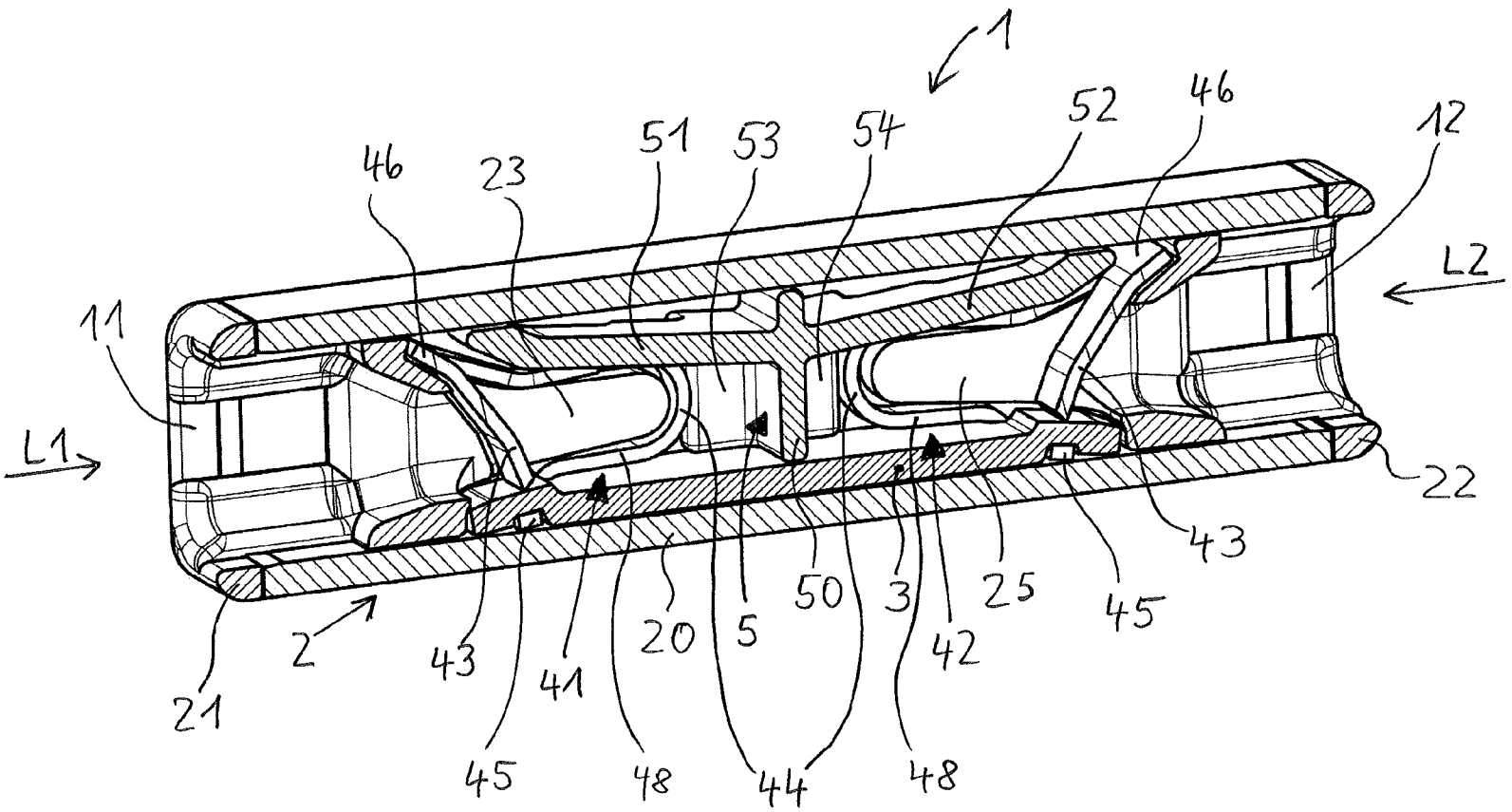
FIG. 1 shows a connecting terminal in a perspective sectional view.

FIG. 1 shows a connecting terminal 1, which includes a housing 2 and a contact insert 3, 41, 42 with an inner piece 5 inserted into housing 2. Housing 2 includes a main housing part 20, which is provided with a tubular design having an essentially square or rectangular cross section. A first closure piece 21 and a second closure piece 22 are each inserted at the two open ends of main housing part 20 as further parts of housing 2. Housing 2 has a first conductor insertion opening 11 in the area of first closure piece 21, into which a first electrical conductor may be inserted in a first conductor insertion direction L1. Housing 2 has a second conductor insertion opening 12 in the area of second closure piece 22, into which a second electrical conductor may be inserted in a second conductor insertion direction L2. First conductor insertion direction L1 and second conductor insertion direction L2 are preferably oppositely oriented.

The contact insert includes a busbar 3, a first clamping spring 41 and a second clamping spring 42. First and second clamping springs 41, 42 each have a root area 46. Arc-shaped side webs 48 and a clamping leg 43 protrude from root area 46. Side webs 48 each include an arc-shaped section 44. Due to their arc shape, side webs 48 extend from root area 46, first approximately in parallel to bus bar 3, and then, after arc-shaped section 44, transition into a further section, which extends approximately in parallel to busbar 3. Side webs 48 are connected to each other via a transverse web 45 at their ends at a distance from root area 46. Transverse web 45 is arranged on the other side of busbar 3 from side webs 48 and clamping leg 43. Particular clamping springs 41, 42 are fastened on busbar 3 hereby. Clamping leg 43 is arranged between two arc-shaped side webs 48 of a clamping spring. Clamping leg 43 extends directly toward busbar 3 when no electrical conductor is clamped on and may abut busbar 3. The free end of clamping leg 43 has a clamping edge and, together with busbar 3, forms a clamping point for an electrical conductor to be connected.

A free space is present between facing arc-shaped sections 44 of first and second clamping springs 41, 42. This free space is at least partially filled by areas of inner piece 5. In particular, a middle area 50, 53, 54 of inner piece 5 is arranged between these arc-shaped sections 44 of first and second clamping springs 41, 42. For example, middle section 50, 53, 54 may include a transverse wall 50, which is arrange transversely to first or second conductor insertion direction L1, L2. This transverse wall 50 divides the interior of housing 2 into two separate chambers. Clamping springs 41, 42 are separated from each other by transverse wall 50. Transverse wall 50 may simultaneously form a conductor stop for the first and/or second electrical conductor(s). Middle section 50, 53, 54 may also include a first longitudinal wall section 53 extending from transverse wall 50 in the direction of first clamping spring 41. Middle section 50, 53, 54 may also include a second longitudinal wall section 54 extending from transverse wall 50 in the direction of second clamping spring 42. The two longitudinal side wall sections 53, 54 are each arranged on both sides of transverse wall 50. Arc-shaped sections 44 each abut the end faces of longitudinal wall sections 53, 54.

Inner piece 5 may also include a first continuation 51, which protrudes from middle section 50, 53, 54 in the direction of first conductor insertion opening 11, and/or a second continuation 52, which protrudes from middle section 50, 53, 54 in the direction of second conductor insertion opening 12. First continuation 51 is situated at a slight angle with respect to first conductor insertion direction L1 or includes a section situated at an angle with respect to first conductor insertion direction L1. Second continuation 52 is situated at a slight angle with respect to second conductor insertion direction L2 or includes a section situated at an angle with respect to second conductor insertion direction L2.

Figure 2:
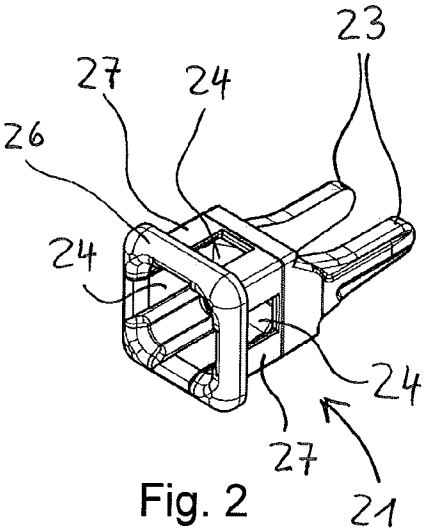
FIG. 2 shows a closure piece in a perspective view.

Based on the example of first closure piece 21 situated on the left, FIG. 2 shows the principle structure of a closure piece of this type. It is apparent that first closure piece 21 includes a frame-like section 26, which is preferably closed on the circumferential side, and has a through-opening forming conductor insertion opening 11. Four side walls 27 protrude from frame-like section 26, which have window-like side openings 24. Two first projections 23 also protrude from frame-like section 26, preferably in the elongation of two side walls 27 situated opposite each other, which run in parallel to each other and are spaced a distance apart from each other. As is apparent based on FIG. 1, first projections 23 extend into the inner area of arc-shaped side webs 48 of first clamping spring 41. Closure piece 21 may also have window-like side openings 24. Window-like openings 24 may be arranged in pairs opposite each other in particular side walls of first closure piece 21. Side walls 27 are recessed inwardly with respect to the circumference of frame-like section 26. The second closure piece may have the same design. Second closure piece 22 may include two protruding projections 25, which extend into the inner area of arc-shaped side webs 48 of second clamping spring 42.

Figure 3:
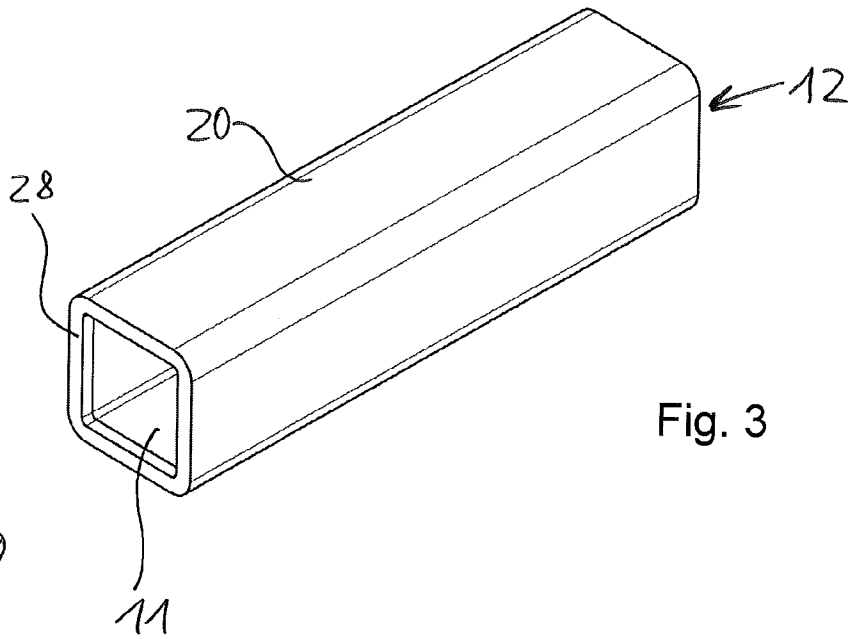
FIG. 3 shows a main housing part in a perspective view.

FIG. 3 shows main housing part 20. The relatively simple structure is apparent, without particular contours or formations on the inner or outer walls. In the mounted state, frame-like section 26 may abut end face 28 of main housing part 20, due to recessed side walls 27 arranged in the interior of main housing part 20 (cf. FIG. 1).

Figure 4:
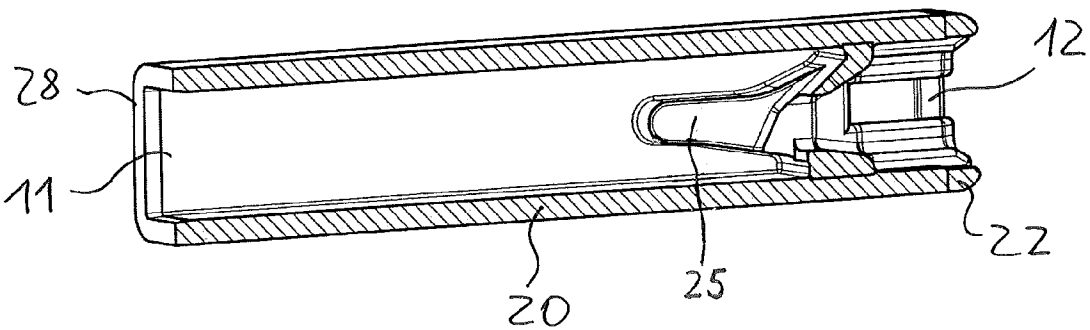
FIG. 4 shows the main housing part, including a closure piece, in a perspective sectional view.

FIG. 4 shows main housing part 20, including inserted second closure part 22.

Figures 5, 6:
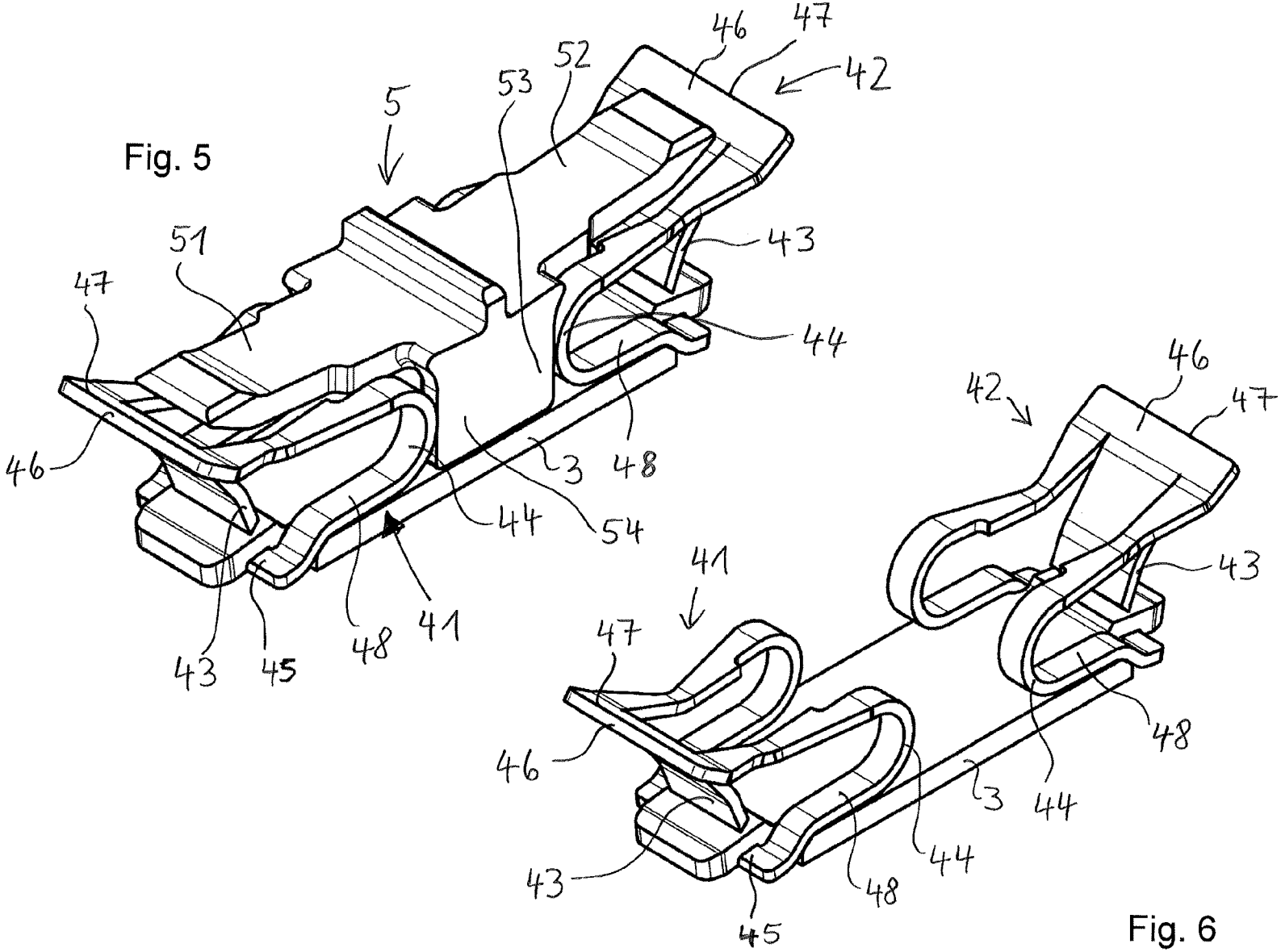
FIG. 5 shows a contact insert, including an inner piece, in a perspective view.
FIG. 6 shows the contact piece according to FIG. 5, without the inner piece.

The contact insert with inner piece 5 mounted thereon, including further details, is apparent from FIG. 5. In particular, the construction of first and second clamping springs 41, 42 is clearly apparent, including side webs 48 and transverse web 45 used for fastening to the busbar. It is also apparent that first and/or second clamping spring(s) 41, 42 may include an edge 47 in root area 46. The clamping spring may be additionally supported by this edge 47 on the inner wall of main housing part 20 and dig slightly therein during tensile loading.

FIG. 6 shows contact insert 3, 41, 42 without inner piece 5.

Figure 7:
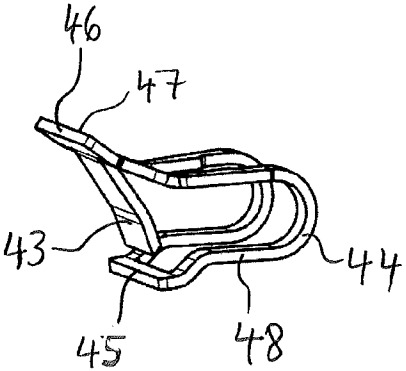
FIG. 7 shows a clamping spring in a perspective view.

FIG. 7 shows an individual clamping spring, which may form the first or the second clamping spring, having the features explained above.

Figure 8:
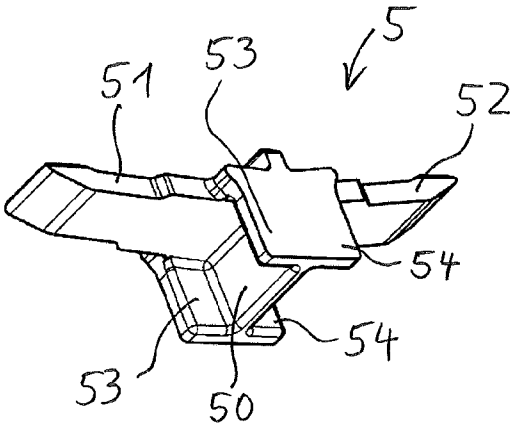
FIG. 8 shows an inner piece in a perspective view.

FIG. 8 shows a view of inner piece 5 in a viewing direction, in which middle section 50, 53, 54 is apparent, which is designed in the manner of a double-T shape. Starting at transverse wall 50, two first longitudinal wall sections 53, which are spaced a distance apart, extend from the two ends of transverse wall 50 in one direction, and two second longitudinal wall sections 54, which are spaced a distance apart, extend in the opposite direction. It is also clear that first continuation 51 and second continuation 52 protrude significantly farther from transverse wall 50 than does particular longitudinal wall section 53, 54.

Figure 9:
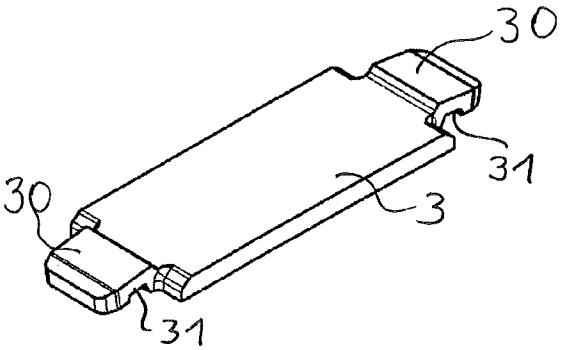
FIG. 9 shows a busbar in a perspective view.

FIG. 9 shows busbar 3. Fastening tongues 30 are apparent, which protrude in the longitudinal direction at the two ends facing away from each other and which simultaneously form the clamping point for the electrical conductor. On the underside of busbar 3, i.e., the side facing away from the clamping point, fastening tongues 30 have particular indentations 31, e.g., in the form of grooves, into which particular transverse web 45 of a clamping spring may be inserted in order to be fastened in this manner on busbar 3 with the aid of a form fit. An elevation may also exist there instead of an indentation of this type.

Figure 10:
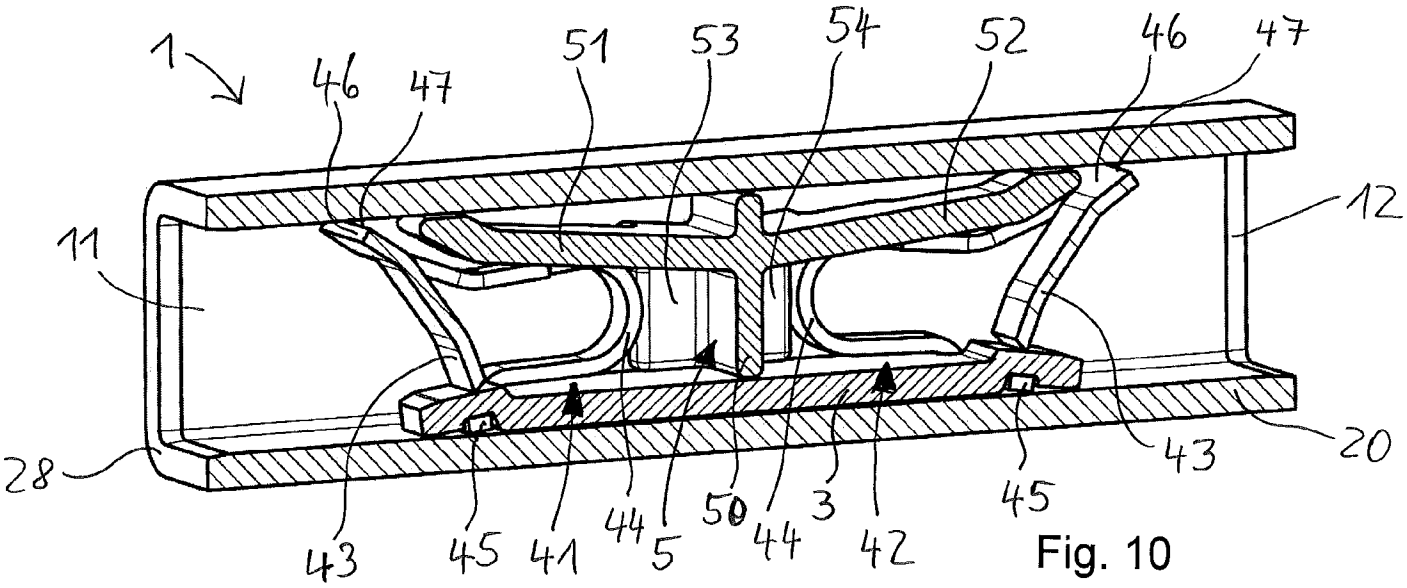
FIG. 10 shows a further specific embodiment of a conductor terminal in a perspective sectional view.

FIG. 10 shows a connecting terminal 1, which is structured, in principle, like connecting terminal 1 described on the basis of FIG. 1, but without closure pieces 21, 22. A connecting terminal 1 of this type may also be used to connect electrical conductors. Connecting terminal 1 may be fitted with first or second closure piece 21, 22 as needed, depending on the user's choice.

Figure 11:
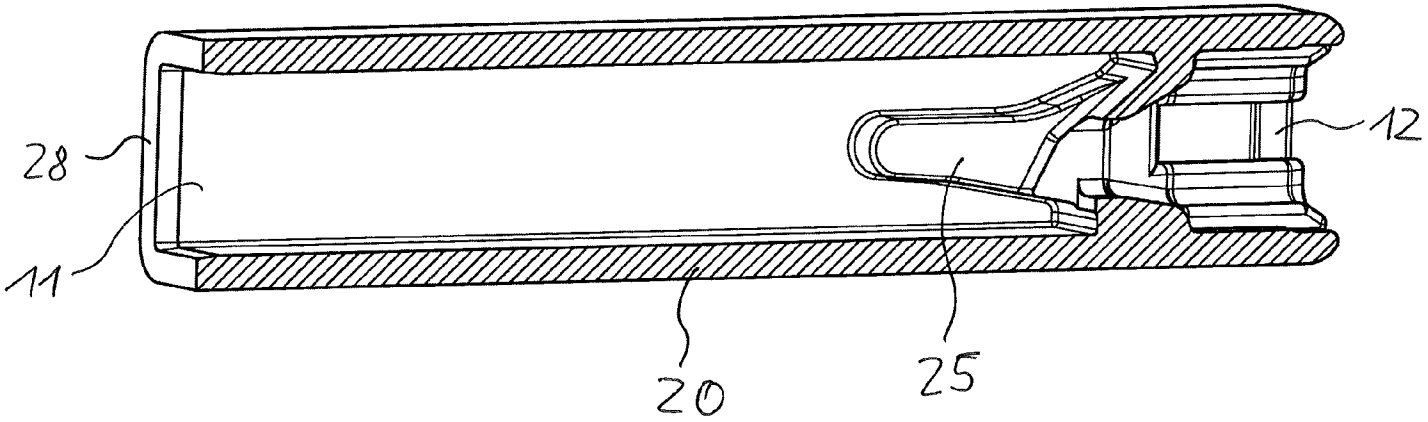
FIG. 11 shows a further specific embodiment of a main housing part in a perspective sectional view.

FIG. 11 shows a main housing part 20, which must be closed with the aid of first closure piece 21 only on the side of first conductor insertion opening 11. The main housing part already includes the corresponding closure elements on the side of second conductor insertion opening 12, and they may be designed similarly to a second closure piece and include, in particular, second projection 25. These closure elements may be formed as a single piece with main housing part 20.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A connecting terminal to connect at least one first electrical conductor to a second electrical conductor, the connecting terminal comprising:

a housing with a first conductor insertion opening for inserting a first electrical conductor and with a second conductor insertion opening for inserting a second electrical conductor, the first and second conductor insertion openings being arranged on opposite sides of the housing;

a contact insert arranged in the housing that includes a first clamping spring, a second clamping spring and a busbar, the first and second clamping springs being fastened in end areas of the busbar facing away from each other;

a free space formed between the first and second clamping springs; and an inner piece arranged in the housing, the inner piece being a separate component from the housing and the contact insert, wherein at least a middle section of the inner piece is arranged predominantly in the free space between the first and second clamping springs.

2. The connecting terminal according to claim 1, wherein the inner piece is made from an insulating material.

3. The connecting terminal according to claim 1, wherein the inner piece is configured to at least partially support and/or abut an area of the first and/or second clamping spring in a form-fitting manner.

4. The connecting terminal according to claim 1, wherein the contact insert forms a self-supporting structural unit with the inner piece that is inserted into the housing in a pre-mounted state.

5. The connecting terminal according to claim 1, wherein the first and second clamping springs each have a clamping leg and arc-shaped sections, and wherein the arc-shaped sections of the first and second clamping springs are arranged at a shorter distance from each other than the clamping legs.

6. The connecting terminal according to claim 1, wherein the inner piece has a first continuation protruding from the middle section in a direction of the first conductor insertion opening and/or the inner piece has a second continuation protruding from the middle section in a direction of the second conductor insertion opening.

7. The connecting terminal according to claim 1, wherein the housing includes a main housing part, which is a one-piece structural unit and extends at least predominantly from the first conductor insertion opening to the second conductor insertion opening.

8. The connecting terminal according to claim 1, wherein the first clamping spring includes two arc-shaped side webs between which a clamping leg of the first clamping spring is arranged.

9. The connecting terminal according to claim 8, wherein the two arc-shaped side webs and the clamping leg protrude from a shared root area of the first clamping spring, and wherein ends of the two arc-shaped side webs are connected to each other at a distance from the shared root area via a transverse web.

10. The connecting terminal according to claim 9, wherein the transverse web is arranged on a side of the busbar facing away from the clamping leg.

11. The connecting terminal according to claim 9, wherein the first clamping spring has an edge at a free end of the shared root area, which points in a direction oriented predominantly opposite a running direction of the clamping leg.

12. The connecting terminal according to claim 1, wherein the contact insert is a push-in connection for directly inserting the first and/or the second electrical conductor.

13. The connecting terminal according to claim 1, wherein the connecting terminal is designed without a separate actuating element for actuating the first and/or second clamping spring.

14. The connecting terminal according to claim 1, wherein the middle section of the inner piece has a concave inner contour in an area facing the first clamping spring, which corresponds to a convex outer contour of the first clamping spring adjacent to the middle section, and/or wherein the middle section of the inner piece has a concave inner contour in an area facing the second clamping spring, which corresponds to a convex outer contour of the second clamping spring adjacent to the middle section.

15. The connecting terminal according to claim 1, wherein the middle section of the inner piece forms a conductor stop for the first and/or second electrical conductor, which limits an insertion depth.

16. The connecting terminal according to claim 1, wherein the first clamping spring is entirely spaced apart from the second clamping spring.

17. A connecting terminal to connect at least one first electrical conductor to a second electrical conductor, the connecting terminal comprising:

a housing with a first conductor insertion opening for inserting a first electrical conductor and with a second conductor insertion opening for inserting a second electrical conductor, the first and second conductor insertion openings being arranged on opposite sides of the housing;

a contact insert that includes a first clamping spring, a second clamping spring and a busbar, the first and second clamping springs being fastened in end areas of the busbar facing away from each other;

a free space formed between the first and second clamping springs; and an inner piece as a further separate component, wherein at least a middle section of the inner piece is arranged predominantly in the free space between the first and second clamping springs, wherein the inner piece has a first continuation protruding from the middle section in a direction of the first conductor insertion opening and/or the inner piece has a second continuation protruding from the middle section in a direction of the second conductor insertion opening, and wherein, in the direction of the first conductor insertion opening, the first continuation extends at an angle, at least in sections, with respect to a conductor insertion direction of the first electrical conductor and/or wherein, in the direction of the second conductor insertion opening, the second continuation extends at an angle, at least in sections, with respect to a conductor insertion direction of the second electrical conductor.

18. The connecting terminal according to claim 17, wherein the first continuation overlaps with the first clamping spring over at least 50% of a longitudinal extension of the first clamping spring in the conductor insertion direction of the first electrical conductor and/or wherein the second continuation overlaps with the second clamping spring over at least 50% of a longitudinal extension of the second clamping spring in the conductor insertion direction of the second electrical conductor.

19. A connecting terminal to connect at least one first electrical conductor to a second electrical conductor, the connecting terminal comprising:

a housing with a first conductor insertion opening for inserting a first electrical conductor and with a second conductor insertion opening for inserting a second electrical conductor, the first and second conductor insertion openings being arranged on opposite sides of the housing;

a contact insert that includes a first clamping spring, a second clamping spring and a busbar, the first and second clamping springs being fastened in end areas of the busbar facing away from each other;

a free space formed between the first and second clamping springs; and an inner piece as a further separate component, wherein at least a middle section of the inner piece is arranged predominantly in the free space between the first and second clamping springs, wherein the housing includes a main housing part, which is a one-piece structural unit and extends at least predominantly from the first conductor insertion opening to the second conductor insertion opening, and wherein the housing includes a first closure piece, which is inserted into the main housing part in an area of the first conductor insertion opening and is used to close the housing in the area of the first conductor insertion opening and/or wherein the housing includes a second closure piece, which is inserted into the main housing part in the area of the second conductor insertion opening and is used to close the housing in the area of the second conductor insertion opening.

20. The connecting terminal according to claim 19, wherein the first closure piece includes at least one first projection protruding into the interior of the main housing part, and/or wherein the second closure piece includes at least one second projection protruding into the interior of the main housing part.

21. The connecting terminal according to claim 20, wherein the at least one first projection overlaps with the first clamping spring over at least 50% of a longitudinal extension of the first clamping spring in a conductor insertion direction of the first electrical conductor and/or wherein the at least one second projection overlaps with the second clamping spring over at least 50% of a longitudinal extension of the second clamping spring in a conductor insertion direction of the second electrical conductor.

22. The connecting terminal according to claim 20, wherein the at least one first projection has a convex outer contour at the free end, which is adapted to a concave inner contour of the first clamping spring adjacent to the first projection, and/or wherein the at least one second projection has a convex outer contour at the free end, which is adapted to a concave inner contour of the second clamping spring adjacent to the second projection.

23. The connecting terminal according to claim 19, wherein the first closure piece and/or the second closure piece each have window-like openings arranged in opposite side walls thereof.

24. A connecting terminal to connect at least one first electrical conductor to a second electrical conductor, the connecting terminal comprising:

a housing with a first conductor insertion opening for inserting a first electrical conductor and with a second conductor insertion opening for inserting a second electrical conductor, the first and second conductor insertion openings being arranged on opposite sides of the housing;

a contact insert that includes a first clamping spring, a second clamping spring and a busbar, the first and second clamping springs being fastened in end areas of the busbar facing away from each other;

a free space formed between the first and second clamping springs; and an inner piece as a further separate component, wherein at least a middle section of the inner piece is arranged predominantly in the free space between the first and second clamping springs, wherein the housing includes a main housing part, which is a one-piece structural unit and extends at least predominantly from the first conductor insertion opening to the second conductor insertion opening, and wherein the main housing part is provided with a tubular design and has a receiving space for receiving the contact insert.

* * * * *